US007467906B2

(12) United States Patent
Gueret

(10) Patent No.: US 7,467,906 B2
(45) Date of Patent: Dec. 23, 2008

(54) PACKAGING AND APPLICATOR DEVICE FOR A COSMETIC COMPOSITION

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 328 days.

(21) Appl. No.: 11/373,093

(22) Filed: Mar. 13, 2006

(65) Prior Publication Data

US 2006/0207622 A1 Sep. 21, 2006

Related U.S. Application Data

(60) Provisional application No. 60/672,555, filed on Apr. 19, 2005.

(30) Foreign Application Priority Data

Mar. 15, 2005 (FR) ..... 05 50668

(51) Int. Cl.
*A46B 11/00* (2006.01)

(52) U.S. Cl. ..... 401/129; 401/126; 401/119

(58) Field of Classification Search ..... 401/118, 401/119, 120, 126, 128, 129, 130
See application file for complete search history.

(56) References Cited

U.S. PATENT DOCUMENTS

| | | | | |
|---|---|---|---|---|
| 3,035,299 | A | 5/1962 | Gordon et al. | |
| 3,739,789 | A | 6/1973 | Cataneo et al. | |
| 4,841,996 | A | 6/1989 | Gueret | |
| 4,854,759 | A | 8/1989 | Morane et al. | |
| 5,339,841 | A | 8/1994 | Gueret | |
| 5,735,623 | A | 4/1998 | Gueret | |
| 6,062,757 | A * | 5/2000 | Gueret | 401/122 |
| 6,174,099 | B1 | 1/2001 | Patel et al. | |
| 6,669,389 | B2 * | 12/2003 | Gueret | 401/122 |
| 6,799,582 | B2 * | 10/2004 | Kim | 132/317 |
| 2002/0039513 | A1 * | 4/2002 | Pink | 401/129 |
| 2002/0054783 | A1 * | 5/2002 | Gueret | 401/202 |

FOREIGN PATENT DOCUMENTS

| | | |
|---|---|---|
| EP | 0 045 690 A2 | 2/1982 |
| EP | 0 553 021 B1 | 7/1993 |
| EP | 0 721 748 B1 | 7/1996 |
| FR | 2 155 688 | 4/1973 |
| FR | 2 585 934 | 2/1987 |

* cited by examiner

*Primary Examiner*—David J Walczak
(74) *Attorney, Agent, or Firm*—Oliff & Berridge, PLC

(57) ABSTRACT

A packaging and applicator device may include an applicator portion. The applicator portion may include: a first receptacle for containing a composition to be applied; an applicator element mounted at one end of a stem that is secured to the first receptacle, at least in use, the stem including at least one internal channel that is configured to communicate with the first receptacle so as to feed the applicator element with composition from the first receptacle; a sheath that is secured to the first receptacle, at least in use, and that surrounds at least part of the stem to form a gap between the sheath and the stem, the internal channel of the stem opening into the gap via at least one opening; and at least one air inlet opening into the gap, above the opening.

18 Claims, 2 Drawing Sheets

PACKAGING AND APPLICATOR DEVICE FOR A COSMETIC COMPOSITION

CROSS-REFERENCE TO RELATED APPLICATIONS

This non-provisional application claims the benefit of French Application No. 05 50668 filed on Mar. 15, 2005 and U.S. Provisional Application No. 60/672,555 filed on Apr. 19, 2005, the entire disclosures of which are incorporated herein by reference.

The present invention relates to packaging and applicator devices for a cosmetic composition, such as, for example, a nail varnish.

The invention applies more particularly to devices in which the applicator includes a receptacle containing the composition to be applied.

BACKGROUND

Exemplary devices are already known, for example, from European patents EP 0 721 748 B1 and EP 0 553 021 B1 and European patent application EP 0 045 690.

In addition, U.S. Pat. No. 4,854,759 describes a device having a receptacle that is distinct from the applicator. The applicator includes a sheath extending around the stem in such a manner as to form a supply of composition, making it possible to increase the amount of time the applicator can be used before being returned to the receptacle. In such a device, the stem is movable relative to the sheath, so as to enable composition to flow along the applicator element while it is being used.

U.S. Pat. No. 4,841,996 discloses another example of a device in which the applicator comprises: a stem that is provided at one end with an applicator element; and a sheath for co-operating with the stem so as to form a gap that is suitable for containing the composition, with a view to increasing the length of time the applicator can be used.

SUMMARY

Exemplary embodiments of the present invention may provide a packaging and applicator device including an applicator portion, the applicator portion comprising:

- a first receptacle configured to contain a composition to be applied;
- an applicator element mounted at one end of a stem that is secured to the first receptacle, at least in use, the stem including at least one internal channel that is configured to communicate with the first receptacle so as to feed the applicator element with composition from the first receptacle;
- a sheath that is secured to the first receptacle, at least in use, and that surrounds at least part of the stem and forms a gap between the sheath and the stem, the internal channel of the stem opening into the gap via at least one opening; and
- at least one air inlet opening into the gap, above the opening.

The sheath may contribute to controlling the flow of composition toward the applicator element. This may make it possible to improve the quality and/or the accuracy of the application.

In exemplary embodiments, the device may include a second receptacle on which the applicator portion may be mounted. For example, the volume of the second receptacle is less than the volume of the first receptacle.

In exemplary embodiments, the second receptacle may be configured to receive a certain quantity of composition or solvent, which may make it possible to maintain the applicator element in an environment that is rich in solvent and retarder, or which prevents the applicator element from drying out. Advantageously, the second receptacle may be transparent, with the second receptacle being made of glass, for example, which may be attractive to the consumer during purchase, enabling the consumer to see the applicator element, and, where appropriate or desired, to see the appearance of the composition, if contained in the second receptacle, for example, to see the color of the composition.

In exemplary embodiments, the second receptacle may recover a possible droplet of composition that is on the applicator element.

In exemplary embodiments in which the second receptacle contains the composition, the second receptacle may also be used to load the applicator element, for example, by shaking the device.

Where appropriate or desired, the second receptacle may contain a member that makes it possible to mix or move the content, for example, a ball or a bead.

In exemplary embodiments, the applicator portion may include a fastener system configured to fasten the applicator portion onto the second receptacle. The fastener system may comprise, for example, a coupling part that is distinct from the first receptacle.

For example, the sheath may be made integrally, i.e., monolithically, with the coupling part, for example, by molding a plastics material.

Alternatively, the sheath may be made independently of the fastener system, with the sheath being fitted to the coupling part, for example.

In exemplary embodiments, the stem may optionally be made integrally, i.e., monolithically, with the coupling part.

For example, the first receptacle may include a flexible wall, for example, which may comprise a co-extrusion. The user may squeeze the wall so as to force the composition to flow toward the applicator element. The first receptacle may optionally be transparent. The first receptacle may also be rigid, with the first receptacle being made of glass, for example.

In exemplary embodiments, the first receptacle may be provided with a pump. The first receptacle and the pump may form a single unit, for example, that is movable relative to the applicator element. This assembly may be capable, for example, of being displaced relative to the fastener system of the applicator portion on the second receptacle, so as to cause the composition to be dispensed toward the applicator element.

In exemplary embodiments, the first receptacle may include a member that makes it possible to mix the composition, for example, a metal ball.

In exemplary embodiments, a length of the applicator element may be such that the applicator element substantially reaches a bottom of the second receptacle.

In exemplary embodiments, before being are used for the first time, the first and second receptacles may be filled, at least in part, with a same composition.

In exemplary embodiments, the second receptacle may include a wall that substantially matches a shape of the applicator portion to be engaged therein. This makes it possible to reduce a volume of the second receptacle, which is no longer used for receiving the composition or the solvent, but merely serves as a closure cap.

In exemplary embodiments, the air inlet may comprise one or more openings formed in the sheath, for example, two diametrally opposite openings. A total airflow section of the opening(s) may be greater than or equal to 1 square millimeter ($mm^2$).

Where appropriate or desired, the opening(s) may enable the composition contained in the second receptacle to reach the gap between the stem and the sheath, for example, when the device is shaken.

In exemplary embodiments, the fluid communication between the applicator element and the first receptacle may be permanent, for example, with the internal channel of the stem not being fitted with a valve or a closure device.

In exemplary embodiments, the applicator element may include a generally flat cross-section.

BRIEF DESCRIPTION OF THE DRAWINGS

Various details of the present invention may will be better understood on reading the following detailed description of non-limiting embodiments, and on examining the accompanying drawings, which form an integral part of the description, and in which.

DETAILED DESCRIPTION OF EMBODIMENTS

Figure 1:
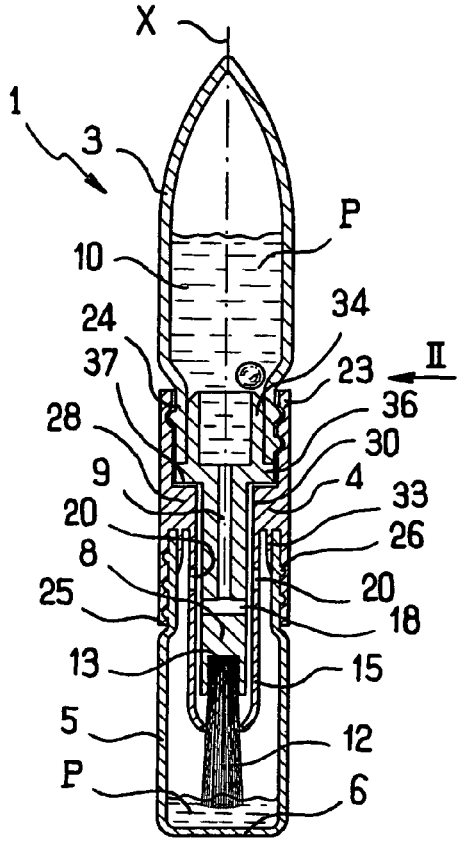
FIG. 1 is a diagrammatic longitudinal cross-sectional view of an exemplary device.
Figure 2:
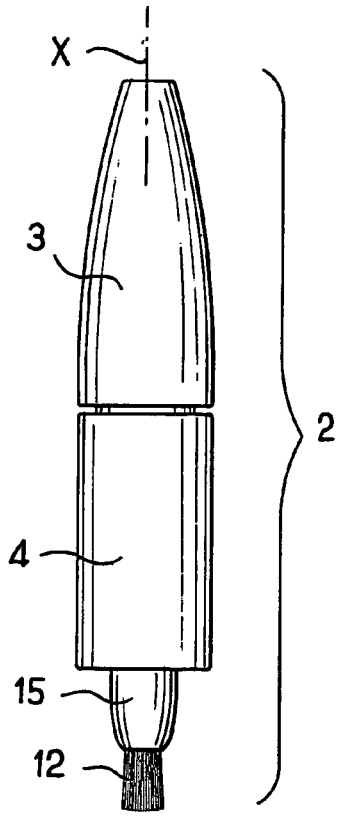
FIG. 2 is an elevation view as seen looking along arrow II in FIG. 1, and showing the applicator portion in isolation.

The exemplary packaging and applicator device 1 shown in FIGS. 1 and 2 includes an applicator portion 2 that is elongate along a longitudinal axis X.

The applicator portion 2 may comprise a first receptacle 3 and a fastener system that enables the first receptacle 3 to be mounted on a second receptacle 5, which, in the exemplary embodiment shown, includes a bottom wall 6 that enables the second receptacle 5 to stand upright when placed on a horizontal planar surface. In the exemplary embodiment shown, the fastener system may comprise a coupling part 4 onto which the first receptacle 3 is fastened.

The first receptacle 3 may contain a fluid composition P, for example, nail varnish.

The applicator portion 2 may include a stem 8, of axis X, provided with an internal channel 9 that is in fluid communication with the inside space 10 of the first receptacle 3.

In the exemplary embodiment shown, a distal end of the stem 8 may carry an applicator element 12 comprising a bundle of bristles that are implanted in a housing 13 of the stem 8, for example, by stapling. An end wall of the housing 13 may be closed such that the composition reaches the applicator element 12 via the outside of the stem 8.

Figure 3:
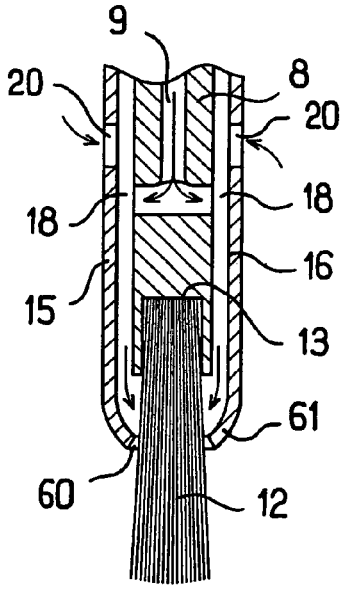
FIGS. 3 and 4 are larger-scale diagrams illustrating the end of the applicator portion containing the applicator element, and illustrating various ways in which the composition may flow toward the applicator element.

The applicator portion 2 may also include a sheath 15, which may optionally be transparent, and that extends in axially stationary manner around the stem 8, forming a relatively narrow gap 16 between itself and the stem 8, as shown in FIG. 3.

The gap 16 may be annular, for example, and a width thereof may be selected, for example, as a function of a viscosity of the composition P and/or desired application characteristics, such as, a desired flowrate. The internal channel 9 may open into the gap 16 via at least one opening, for example, two diametrally opposite openings 18 in the exemplary embodiment shown.

An air inlet may be formed above the openings 18. The air inlet may be in the form of two diametrally opposite openings 20 passing through the sheath 15, in the exemplary embodiment shown.

For example, the stem 8 and the sheath 15 may be of circular cross-section. Alternatively, the cross-section thereof need not be circular, for example, to encourage the flow of composition to a predefined region of the applicator element.

In the exemplary embodiment shown, a top of the coupling part 4 may include a first assembly skirt 23 of axis X. The first receptacle 3 may include a neck 24 that is configured to be fastened, for example, screwed, into the skirt 23.

A bottom of the coupling part 4 may include a second assembly skirt 25 of axis X. The second receptacle 5 may include a neck 26 that is configured to be fastened, for example, screwed, into the skirt 25.

The assembly skirts 23 and 25 may be interconnected via an intermediate portion 28 including a passage 30 passing therethrough, and through which the stem 8 extends. The top of the sheath 15 may be connected to the intermediate portion 28, and, in the embodiment shown, the sheath may be made integrally, i.e., monolithically, with the coupling part 4 by molding.

In the embodiment shown, an annular sealing lip 33 may be provided for bearing against an inside surface of the neck 26, so as to enable the second receptacle 5 to be mounted in a sealed manner on the coupling part 4. For example, the lip 33 may be made integrally, i.e., monolithically, with the coupling part 4 by molding.

In the exemplary embodiment shown, the stem 8 may be secured to the first receptacle 3 by an endpiece 34 that is force-fitted in the neck 24. As shown, the endpiece 34 may be connected to a disk 36 including one side that comes to bear against an edge of the neck 24, and the other side that comes to bear against an annular flange 37 that projects into the bottom of the housing defined by the assembly skirt 23.

In the exemplary embodiment shown, the sheath 15 may extend beyond the end of the stem 8, thereby covering the applicator element 12 in part.

In the embodiment shown, the sheath 15 may include an inwardly-curved bottom edge 61 that defines an opening 60 through which the applicator element 12 passes.

The first receptacle 3 may include a flexible shape-memory wall that is made by co-extrusion, for example, so as to enable the user to force the composition to flow toward the applicator element 12 by squeezing two opposite faces.

The first receptacle 3 may optionally be transparent. In exemplary embodiments, the second receptacle 5 is preferably transparent, with the second receptacle being made of glass, for example.

The device 1 may be operated as follows.

The user may squeeze the wall of the first receptacle 3 so as to forces the composition P to flow through the internal channel 9 toward the openings 18, or may allow the composition P to flow naturally by gravity. The composition P located in the gap 16 may flow by gravity toward the applicator element 12, as a result of the air entering via the openings 20, as shown by the arrows in FIG. 3.

Figure 4:
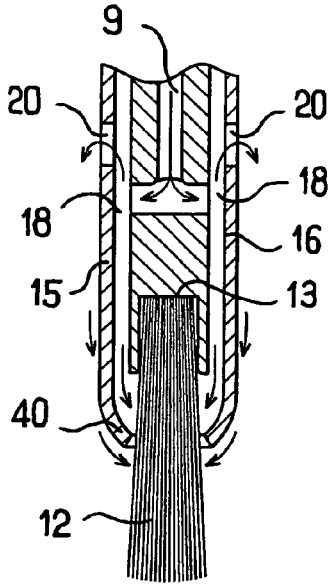

In the event of too much composition entering the gap 16, for example, if the user has squeezed the first receptacle 3, composition P may optionally leave via the openings 20, as shown in FIG. 4, then flow over the outside surface of the sheath 15, before reaching the applicator element 12. The curved edge 61 of the sheath may encourage the composition flowing over the outside surface of the sheath 15 to flow toward the applicator element 12.

After application, the user may fasten the applicator portion 2 onto the second receptacle 5. The composition P located in the bottom of the receptacle makes it possible to maintain the applicator element 12 in an environment that is rich in solvent, thereby preventing the applicator element 12 from drying out, and it makes it possible for the user to benefit more quickly from an operational applicator element 12 the next time the applicator element is used.

Naturally, various modifications may be applied to the above-described device without going beyond the ambit of the present invention. For example, the coupling part 4 may be made in some other way, as shown in FIG. 5.

Figure 5:
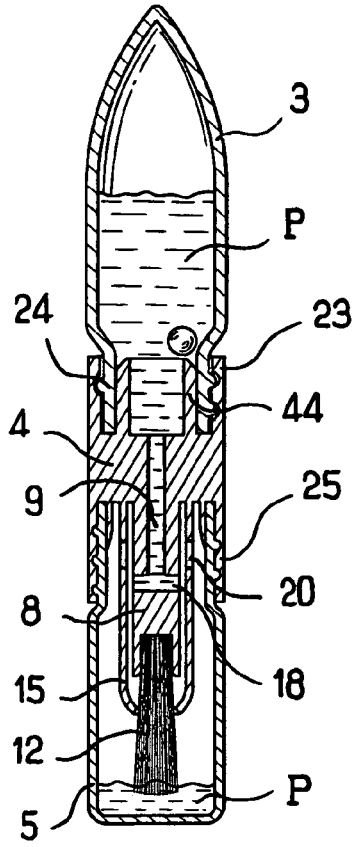
FIGS. 5 to 7 are views similar to FIG. 1, illustrating other exemplary devices.

As shown in FIG. 5, the stem 8 may be made integrally, i.e., monolithically, with the coupling part 4 and with the sheath 15, for example, by molding a plastics material.

The coupling part 4 may include an annular sealing lip 44 that is engaged in the neck 24 of the first receptacle 3.

Figure 6:
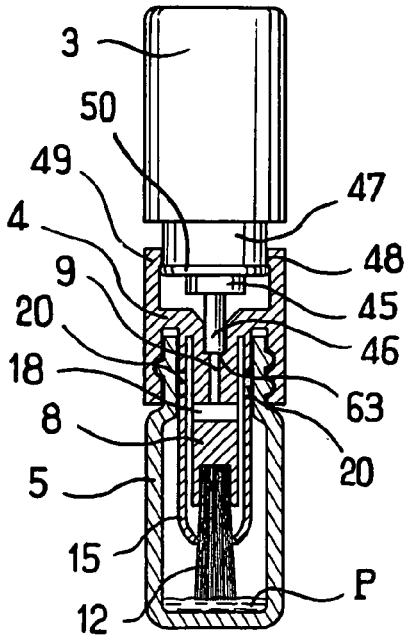

In the exemplary embodiment illustrated in FIG. 6, the first receptacle 3 may be provided with a pump 45 that includes a valve rod 46 that is engaged in the coupling part 4, and that comes axially into abutment against a shoulder 63 of the internal channel 9 of the stem 8, the stem being suitable for being made integrally, i.e., monolithically, with the coupling part 4.

The first receptacle 3 may include a tubular portion 47 that is configured to slide relative to the coupling part 4, such that the user may dispense the composition by pressing on the first receptacle 3 so as to displace the first receptacle 3 toward the applicator element 12, thereby actuating the pump 45.

Once pressure so generated is released, the first receptacle 3 may return to an initial position thereof, for example, by resilient return means incorporated in the pump 45.

In the exemplary embodiment shown, the first receptacle 3 may be held on the coupling part 4 by a rim 48 that is formed at a top portion of a guide skirt 49 that replaces the assembly skirt 23 described above. The first receptacle 3 may include an annular holding flange 50 that configured to pass over the rim 48 by snap-fastening.

Figure 7:
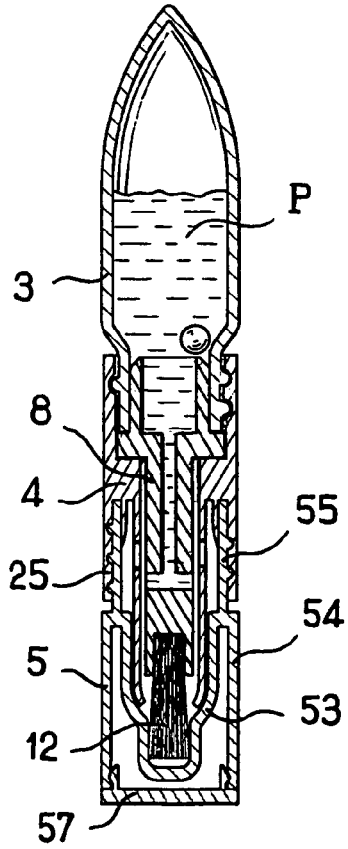

The embodiment shown in FIG. 7 differs from the embodiment shown in FIG. 1 by the shape of the second receptacle 5, which includes an inside wall 53 that substantially matches a shape of the distal portion of the applicator portion, so as to minimize a free volume around the applicator element 12 when the applicator element is in place in the second receptacle 5.

For example, the wall 53 may be in the shape of a finger of a glove, and may be made integrally, i.e., monolithically, with an outer skirt 54 that extends downward in registration with an outside surface of the coupling part 4, by molding a plastics material, for example. As shown, the outer skirt 54 may be extended upward by a neck 55, making it possible to fasten the outer skirt 54 onto the assembly skirt 25.

A bottom wall 57 may be fitted to the outer covering skirt 54, with the bottom wall being fastened onto the outer skirt 54 by snap-fastening.

Naturally, the invention is not limited to the embodiments described above. In particular, it is possible to modify still further the shape of the first and second receptacles, and the shape of the coupling part 4.

The applicator element 12 may be constituted by something other than a bundle of bristles, for example, a flocked endpiece, a foam, a felt-tip, a brush, or a flexible tip.

In exemplary embodiments in which the applicator element 12 forms a brush of the paint-brush type, the brush may be made with a mixture of bristles, for example, such as with bristles of different shapes and/or different materials.

The shape of the brush may be varied, with the shape being of cylindrical cross-section, or trough-shaped, for example. The bristles may be rectilinear or undulated, of a same diameter or of different diameters, of solid cross-section or hollow cross-section, or a mixture thereof.

For example, the bristles may be made of polyamide (PA), polypropylene (PP), polyoxymethylene (POM), polyethylene terephthalate (PET), silicone, or polytetrafluoroethylene (PTFE).

The bristles may contain sliding agents, fillers that change their surface state, and/or magnetic particles.

The first receptacle may include any shape other than that shown, and optionally may be deformable.

The composition contained in the device may be other than a nail varnish. For example, the composition may be a makeup composition or a care product for applying to skin, lips, or keratinous fibers, for example.

The gap between the stem and the sheath may be other than annular. The sheath may be suitable, for example, for including, on its inside surface, portions in relief such as stripes or rings, or may be made with internal grooves or ribs, for example, that are configured to locally encourage the flow of the composition, for example, so as to guide the composition into one or more predefined regions of the applicator element. For example, the stem may include an oblong cross-section with one or two grooves on long sides thereof, so as to guide the composition preferably substantially mid-way across the brush, such as when the brush includes a flat section.

The air may be admitted other than via one or more openings in the sheath, for example, via one or more air passages in the intermediate portion 28.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The expression "comprising a" should be understood as being synonymous with "comprising at least one," unless specified to the contrary.

What is claimed is:

1. A packaging and applicator device including an applicator portion, the applicator portion comprising:

a first receptacle configured to contain a composition to be applied;

an applicator element mounted at one end of a stem that is secured to the first receptacle, at least in use, the stem including at least one internal channel that is configured to communicate with the first receptacle so as to feed the applicator element with composition from the first receptacle;

a sheath that is secured to the first receptacle, at least in use, and that surrounds at least part of the stem and forms a gap between the sheath and the stem, the internal channel of the stem opening into the gap via at least one opening; and at least one air inlet opening into the gap, above the opening, wherein the air inlet comprises at least one opening formed in the sheath.

2. A device according to claim 1, further comprising a second receptacle that is configured to have the applicator portion mounted thereon.

3. A device according to claim 2, wherein the applicator portion includes a fastener system configured to fasten the applicator portion onto the second receptacle.

4. A device according to claim 3, wherein the fastener system comprises a coupling part that is distinct from the first receptacle.

5. A device according to claim 3, wherein the sheath is made monolithically with a coupling part of the fastener system.

6. A device according to claim 3, wherein the stem is made monolithically with a coupling part of the fastener system.

7. A device according to claim 2, wherein a length of the applicator element is such that the applicator element substantially reaches a bottom of the second receptacle.

8. A device according to claim 2, wherein the second receptacle comprises a wall that substantially matches a shape of the applicator portion to be engaged therein.

9. A device according to claim 2, wherein the second receptacle is transparent.

10. A device according to claim 2, wherein the second receptacle comprises glass.

11. A device according to claim 1, wherein the first receptacle comprises a non-transparent wall.

12. A device according to claim 1, wherein the first receptacle includes a flexible wall.

13. A device according to claim 1, wherein the first receptacle comprises a co-extrusion.

14. A device according to claim 1, wherein the first receptacle is provided with a pump.

15. A device according to claim 1, wherein the first receptacle and the pump comprise a single unit that is movable relative to the applicator element.

16. A packaging and applicator device including an applicator portion, the applicator portion comprising:

a first receptacle configured to contain a composition to be applied;

an applicator element mounted at one end of a stem that is secured to the first receptacle, at least in use, the stem including at least one internal channel that is configured to communicate with the first receptacle so as to feed the applicator element with composition from the first receptacle;

a sheath that is secured to the first receptacle, at least in use, and that surrounds at least part of the stem and forms a gap between the sheath and the stem, the internal channel of the stem opening into the gap via at least one opening;

at least one air inlet opening into the gap, above the opening; and a second receptacle that is configured to have the applicator portion mounted thereon;

wherein, before being used for a first time, the first and second receptacles contain a same composition.

17. A device according to claim 1, wherein a total airflow section of the at least one opening is at least about 1 $mm^2$.

18. A device according to claim 1, wherein fluid communication between the applicator element and the first receptacle is permanent.

* * * * *